United States Patent [19]

Sears

[11] 4,093,278

[45] June 6, 1978

[54] DYE SOLVENTS FOR PRESSURE-SENSITIVE COPYING SYSTEMS

[75] Inventor: James Kern Sears, Webster Groves, Mo.

[73] Assignee: Monsanto Company, St. Louis, Mo.

[21] Appl. No.: 754,467

[22] Filed: Dec. 27, 1976

[51] Int. Cl.[2] ..... B41M 5/22

[52] U.S. Cl. ..... 282/27.5; 427/145; 427/150; 427/151; 428/307; 428/325; 428/327; 428/511; 428/914

[58] Field of Search ..... 282/27.5; 428/914, 306, 428/307, 476, 325, 327, 511; 427/145, 151, 150

[56] References Cited

U.S. PATENT DOCUMENTS

| | | | |
|---|---|---|---|
| 2,646,367 | 7/1953 | Davis et al. | 428/446 |
| 3,427,180 | 2/1969 | Phillips | 428/306 |
| 3,684,549 | 8/1972 | Shank | 428/476 |
| 3,968,320 | 7/1976 | Herber et al. | 427/145 X |
| 4,018,728 | 4/1977 | Priest | 428/914 |
| 4,021,059 | 5/1977 | Skelly et al. | 282/27.5 |

*Primary Examiner*—Thomas J. Herbert, Jr.
*Attorney, Agent, or Firm*—William H. Duffey

[57] ABSTRACT

Solvents useful to dissolve dyes employed in pressure-sensitive copying systems comprise aryl esters of benzoic or substituted benzoic acid having the structure:

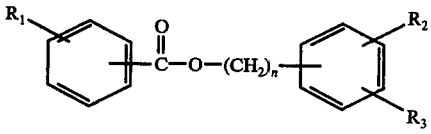

wherein $R_1$ is hydrogen, methyl or ethyl; $R_2$ is hydrogen or $C_1$ to $C_9$ alkyl; $R_3$ is hydrogen, methyl or ethyl; and $n$ is zero or 1.

13 Claims, No Drawings

DYE SOLVENTS FOR PRESSURE-SENSITIVE COPYING SYSTEMS

BACKGROUND OF THE INVENTION

1. Field of the Invention

This invention relates to pressure-sensitive copying systems of the kind in which a substantially colorless color former (dye) held within microcapsules is reacted, upon rupturing of the microcapsules by an applied pressure, with a coreactant material to form distinctive colored marks. More particularly, the present invention relates to improved dye solvents useful in pressure-sensitive copying systems.

2. Description of the Prior Art

In one conventional pressure-sensitive copying system, the microcapsules are carried on one surface of a transfer sheet, referred to as a CB (coated back) sheet and the coreactant material is carried on one surface of a record sheet, referred to as a CF (coated front) sheet. In another embodiment, the microcapsules and the co-reactant material are carried on the same surface of a single sheet. In systems for making a plurality of copies intermediate CFB (coated front and back) sheets are provided. The sheets are usually made of paper.

Most known CB sheets carry a coating of microcapsules, which may be separate or in capsular units, i.e., clusters of capsules. Each microcapsule comprises a wall of hydrophilic colloid material such as gelatin, containing a substantially colorless chromogenic material (color former) of basic reactant chemical properties which, in use, contacts and is colored by a co-reactant material.

The co-reactant material is typically a finely divided acidic compound which is also substantially colorless in its natural form. Commonly used co-reactant materials include organic polymers and inorganic clays which are applied to the CF sheet in a suitable paper coating binder material such as starch, casein, polymer or latex.

Distinctive colored marks occur on the CF sheet following rupture of the microcapsules through localized pressure from writing, typing or printing on the noncoated front surface of a CB sheet which is positioned with its coated back surface in contact with the coated front surface of a CF sheet.

The substantially colorless color former produces color only under acidic conditions, that is, upon contact with the acidic co-reactant of the CF sheet. The color former is always dissolved in a solvent and, in many cases, is diluted with kerosene or the like. It is therefore important that the color former solution possess the required physical and chemical properties.

Generally desirable properties of the color former solution are that it be easily encapsulated by conventional techniques; that it have good shelf life in the encapsulated form; and that it be stable at moderately elevated temperatures. It is also important that the mark produced as a result of the reaction between the color former and the co-reactant develop rapidly, be fade resistant and be resistant to bleeding or feathering as a result of capillary action or other surface phenomena.

The dye solvent (color former solvent) functions to provide a carrier for the color former and a medium for the reaction between the color former and the acidic co-reactant material. The solvent must be capable of holding the color former in solution within the microcapsule, of carrying the color former to the sensitized surface of the CF sheet when the microcapsule is ruptured, and of promoting or at least not inhibiting color development with the co-reactant. In addition, since inadvertent rupture of the microcapsule is possible by careless handling, the solvent must be noninjurious to skin, clothing or environment.

The solvent is an important factor in determining the performance of the pressure-sensitive copying system in terms of stability of the sheets to heat and storage time, rate of color development, extent of color development, and durability of image. Certain prior art dye solvents have exhibited adequate print speed and color intensity on the widely used phenolic resin-coated CF sheets. In some cases, however, objectionable odors in the copying systems have been ascribed to the dye solvent itself. Such odors obviously detract from commercial acceptance of such copying systems even though the dye solvent performance is otherwise superior.

Many non-halogenated aromatic hydrocarbons are known to the art as dye solvents for pressure-sensitive copying systems. Among these are diaryl alkanes, triaryl dialkanes, alkylated biphenyls, alkylated terphenyls, partially hydrogenated terphenyls, alkylnaphthalenes, benzylnaphthalenes and benzyl aryl ethers.

Certain esters have been mentioned in the prior art as dye solvents for pressure-sensitive copying systems. Dioctyl phthalate, for example, was disclosed in U.S. Pat. No. 2,646,367 which issued July 21, 1953. Methyl salicylate, also mentioned long ago as a possible dye solvent, was said to exhibit objectionable odor. Dimethyl adipate, diisodecyl adipate, benzyl acetate and butyl benzyl phthalate, like many esters, have been found to be undesirable as dye solvents because those esters must evaporate before they will permit the color to form. It has been found for example, that a test solution of diisodecyl adipate as a dye solvent had still not formed a color on a receiving sheet after three years of delay. It has further been found that ethyl acetate as a dye solvent totally inhibits color formation because, it is theorized, the ester groups tie up the acid sites on the clay or phenolic resin receiving sheet through hydrogen bonding.

Dibenzyl glutarate, although having good solubility properties, is too slow in print speed. Phenyl acetate and benzyl butyrate are likewise too slow.

In general, therefore, esters have not achieved widespread adoption as dye solvents for pressure-sensitive copying systems even though many esters are in plentiful supply as articles of commerce.

It is an object of the present invention to provide ester dye solvents for pressure-sensitive copying systems which have acceptable odor characteristics yet possess adequate print speed and color intensity together with otherwise suitable properties. Further objects of this invention will become apparent from the following description and examples.

SUMMARY OF THE INVENTION

For reasons not fully understood, it has been found that certain aryl esters and benzyl esters of benzoic acids are outstanding dye solvents for pressure-sensitive copying systems. A preferred ester within the present invention is benzyl benzoate. Benzyl benzoate has a pleasing sweet odor.

Thus the dye solvents of this invention which are useful in pressure-sensitive copying systems are represented by the following structure:

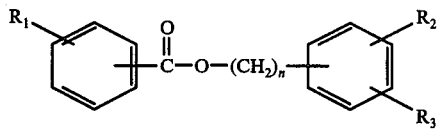

wherein $R_1$ is hydrogen, methyl or ethyl; $R_2$ is hydrogen or $C_1$ to $C_9$ alkyl; $R_3$ is hydrogen, methyl or ethyl; and $n$ is zero or 1.

DESCRIPTION OF PREFERRED EMBODIMENTS

The pressure-sensitive copying systems utilizing the improved dye solvents of the present invention may be prepared according to well known conventional procedures. Descriptions of methods for preparing the CB sheet and the CF sheet are to be found in the literature and such methods do not constitute a part of the present invention. Coating of the coreactant material, whether inorganic clay or organic polymer type, is conducted according to such established procedures. Similarly, formation and application of microcapsules onto the CB sheet is fully disclosed in the literature. The solvents of this invention may be substituted for conventional dye solvents in order to produce improved pressure-sensitive copying systems according to such conventional procedures.

The solvents of the present invention are preferably utilized in combination with one or more of several conventional color formers of normally colorless form. One such class of color formers comprises colorless aromatic double bond organic compounds which are converted to a more highly polarized conjugated and colored form when reacted with an acidic sensitizing material on the CF sheet. A particularly preferred class of color formers includes compounds of the phthalide type such as crystal violet lactone (CVL) which is 3,3-bis(p-dimethylaminophenyl)-6-dimethylaminophthalide and malachite green lactone which is 3,3-bis(p-dimethylamino-phenyl)phthalide. Other phthalide derived color formers include 3,3-bis(p-m-dipropylamino-phenyl)phthalide, 3,3-bis(p-methylaminophenyl)phthalide, 3-(phenyl)-3-indole-3-yl)phthalides such as 3-(p-dimethylaminophenyl)-3-(1,2-dimethylindol-3yl) phthalide, 3,3-bis(phenylindol-3-yl)phthalides such as 3,3-bis-(1,2-dimethylindol-3-yl)phthalide, 3-(phenyl)-3-(heterocyclic-substituted)phthalides such as 3-(p-dimethylaminophenyl)-3-(1-methylpyrr-2-yl-6-dimethylaminophthalide, indole and carbazole-substituted phthalides such as 3,3-bis(1,2-dimethylindol-3-yl)-5-dimethylaminophthalide and 3,3-bis(9-ethylcarbazol-3yl)-5-dimethylaminophthalide, and substituted indole phthalides such as 3-(1,2-dimethylindol-3yl)-3-(2-methylindol-3-yl)phthalide.

Other color formers also useful in the practice of this invention include indole substituted pyromellitides such as 3,5-bis(p-dimethylaminophenyl)-3,5-bis(1,2-dimethylindol-3-yl)pyromellitide, 3,7-bis(p-diethylamino-phenyl)-3,7-bis(1,2-dimethylindol-3yl)pycomellitude, 3,3,7,7-tetrakis-(1,2-dimethylindol-3-yl)pyromellitide and 3,3,5,5-tetrakis-(1,2-dimethylindol-3-yl)pyromellitide; and leucauramines and substituted leucauramines such as p-xylyl-leucauramine and phenyl-leucauramine. Also included are orthohydroxybenzoacetophenone, 2,4-bis[p-(p-dimethylaminophenylazo)aniline]-6-hydroxy-symtrazine, N,3,3-trimethylindolinobenzospiropyrans, and N,3,3-trimethylindolino-$\beta$-naphthospiropiranes.

An auxiliary coloring agent can be employed with the above color formers to provide fade resistance where fading is a problem. Many phthalide compounds such as crystal violet lactone for example, are characterized by rapid color development with a normal tendency to fade during the course of time. One suitable auxiliary coloring agent is benzoyl leuco methylene blue which oxidizes when released on the paper to slowly form a permanent blue color. The combination of a phthalide color former and such a colorless oxidizable auxiliary coloring agent provides a composition having both rapid color development and fade resistance.

The dye solvents of this invention are broadly described as aryl esters, preferably benzyl esters, of benzoic acid or substituted benzoic acid, e.g. methylbenzoic (toluic) acid. Benzyl benzoate is the preferred species. The dye solvents of this invention are characterized by the following structure:

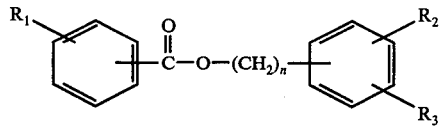

wherein $R_1$ is hydrogen, methyl or ethyl; $R_2$ is hydrogen or $C_1$ to $C_9$ alkyl; $R_3$ is hydrogen, methyl or ethyl; and $n$ is 0 or 1.

The solvents of this invention which are liquids at room temperature may be used alone or in combination with diluents. Solvents which are solids or semisolids at room temperature must necessarily be used in combination with another material, hereinafter referred to as a diluent, in order to provide a mixture having the requisite degree of liquidity for use in pressure-sensitive recording paper systems. For purposes of this invention the term "diluent" includes both inert or substantially inert materials which are of little practical use alone as dye solvents either because they have poor solvating power for the chromogen or because they act in some way to inhibit the development of color, as well as some more active materials such as aromatic organic compounds which may be useful by themselves as dye solvents.

Either type of diluent may be used in combination with the solvents of this invention. For example, a solvent may be admixed with from 0 to about 3 parts of a diluent for each part of solvent wherein the diluent is a mineral or vegetable oil, such as kerosene, paraffin oil, mineral spirits, castor oil, neatsfoot oil, sperm oil, lard oil, olive oil, soybean oil, cottonseed oil, coconut oil, or rapeseed oil, or an organic aryl compound such as aromatic naphtha, $C_{1-12}$ alkyl benzene, benzyl biphenyl, of $C_{1-6}$ alkylaryl indane. Biodegradable monoalkylbenzene mixtures, sometimes called "alkylates" are particularly useful as diluents with dye solvents of this invention. Such alkylates are commercially available as intermediates for the manufacture of anionic liquid and solid detergents.

The diluents referred to herein function to alter physical properties of the solvent such as viscosity or vapor pressure as may be desired for handling or processing considerations. The diluents may also serve to reduce the total cost of the solvent in the system and to enhance in some instances the performance of the solvent particularly with respect to speed of color development or resistance to fade.

The solvents may also contain certain additives specifically intended to alter or control the final properties of the fluid as for example viscosity control agents, vapor pressure control agents, freezing point depressants, odor masking agents, antioxidants, colored dyes and the like.

In a preferred embodiment of the present invention, the chromogenic material (color former) is dissolved in a selected solvent to form a marking liquid which is reactive with the acidic solid coreactant material. The acidic material can be any compound within the definition of a Lewis acid, i.e., an electron acceptor with reference to the chromogen, which promotes the polarization of the chromogen into a colored form. The solid acidic material further serves as an adsorbent of the marking fluid to receive the transferred image. Commonly used acidic materials include acid clays and acidic organic polymeric materials such as phenolic polymers, phenolacetylene polymers, maleic acid-rosin resins, partially or wholly hydrolyzed styrene-maleic anhydride copolymers and ethylene-maleic anhydride copolymers, carboxy polymethylene and wholly or partially hydrolyzed vinyl methyl ether, maleic anhydride copolymer and mixtures thereof. Superior results are achieved herein with the phenolic type acidic materials, i.e., phenolic resin CF sheet.

The dye solvents of this invention, with or without the presence of a diluent, and in admixture with the chromogenic material (color former), are usually microencapsulated according to procedures well known and broadly described in the art. The microcapsules are typically coated onto one surface of a CB sheet and the acidic coreactant (electron accepting) material is carried on one surface of the CF sheet.

To illustrate the superiority of the dye solvents of this invention, the rate and extent of color development of several solvents was determined in a laboratory procedure. Some of the tested solvents were within the scope of the present invention and some were outside. All were esters.

The laboratory procedure consisted of preparing a marking fluid comprising a solution of a chromogen (color former) in the solvent or solvent composition to be tested, applying the fluid to CF paper coated with a phenolic resin coreactant material, and measuring the print speed and color intensity.

In the test procedure the marking fluid was prepared by adding sufficient crystal violet lactone color former to the dye solvent to achieve 1.5 weight percent concentration of the color former. This was followed by agitation and warming to 100°–120° C. if necessary to achieve solution. The solution was then cooled to room temperature, seeded with a few crystals of the color former, and allowed to stand for several days with occasional shaking to assure that the solution was not supersaturated.

The solvent/color former solution was thereupon saturated into a blotter. The blotter was daubed 7 times with a pencil eraser. The material on the pencil eraser, approximately 1 microliter of the solvent/color former solution, was transferred to a phenolic resin CF sheet and color intensity was measured.

A Macbeth digital read-out Reflection Densitometer was employed, using filters for color, to measure optical density. The optical density measurements obtained from the Reflection Densitometer were seen visually and were recorded on a Sanborn recorder which plots optical density versus time.

Print speed is defined herein as the time (in seconds) from injection of the solvent/color former solution until an optical density of 40 is achieved on the CF sheet. It has been found difficult to visually distinguish color change above a value of 40.

Color intensity for each of the samples tested was derived from the recording at a defined elapsed time. Higher readings signify darker color.

The results of tests evaluating aryl ester dye solvents of this invention in comparison to other esters are presented in Table 1 which follows. The specific materials presented in Table 1 are for purposes of illustration only and the present invention is not to be limited thereto.

TABLE 1

| | | PHENOLIC RESIN CF SHEET | | | |
|---|---|---|---|---|---|
| | | | Color Intensity | | |
| Solvent | Dye Solvent Composition (By Weight) | Print Speed (seconds) | at 15 seconds | at 30 seconds | at 60 seconds |
| A | 100% Dioctyl phthalate | 35 | 32 | 38 | 42 |
| B | 67% Dioctyl phthalate<br>33% Kerosene | 8 | 42 | 48 | 50 |
| C | 100% Benzyl acetate | None | 14 | 14 | 14 |
| D | 67% Benzyl acetate<br>33% Kerosene | None | 20 | 20 | 20 |
| E | 67% Dibenzyl glutarate<br>33% Mixed $C_{11}$ and $C_{12}$ alkylybenzene | 10 | 40 | 42 | 42 |
| F | 100% Dibenzyl glutarate | None | 32 | 32 | 32 |
| G | 100% Benzyl benzoate | 3 | 43 | 45 | 46 |
| H | 67% Benzyl benzoate<br>33% Kerosene | 1 | 51 | 52 | 52 |

The results in Table 1 above illustrate the superior performance obtained with Solvents G and H (benzyl benzoate) which is within the scope of this invention. Print speed was suitably fast and color intensity was desirably high. In contrast, many other esters as exemplified by Solvents A through F do not meet the high performance levels of benzyl benzoate as a dye solvent for pressure-sensitive copy paper systems. Where the word "None" is entered in Table 1 for print speed, that entry signifies that the particular dye solvent or solvent composition being tested fail to achieve a color intensity reading of at least 40. In some cases the presence of kerosene and/or alkylbenzene diluent caused improvement in dye solvent performance. A desirable stabilized color intensity value is 50.

To illustrate the improved performance on clay-coated CF paper of aryl ester dye solvents of this invention, still another laboratory test procedure was employed. This procedure was in the nature of a color development test which is described as follows.

The color development test consisted of laying a bead of the marking fluid (color former plus dye solvent with or without a diluent) by means of a medicine dropper across a 3.1 cm. wide strip of clay-coated CF paper.

Using a razor blade, the bead was knife-coated along the paper strip. Using a stopwatch, the time for each marking fluid to cause the clay CF sheet to reach maximum color intensity or color development was recorded. Color development was measured with a Photovolt Reflection Meter.

In each case, the marking fluid was prepared by adding sufficient crystal violet lactone color former to the dye solvent to achieve 5.0 weight percent concentration of the color former. This was followed by agitation and warming to 100°-120° C. if necessary to achieve solution. The solution was then cooled to room temperature, seeded with a few crystals of the color former and allowed to stand for several days with occasional shaking to assure that the solution was not supersaturated.

The results of color development tests on various ester compounds are presented in Table 2 which follows.

TABLE 2

| | CLAY-COATED CF SHEET | |
|---|---|---|
| Solvent | Dye Solvent Composition (by weight) | Time to Max. Color (seconds) |
| I | 100% Benzyl benzoate | 1 |
| J | 100% Benzyl n-butyrate | 60 |
| K | 100% Benzyl acetate | >60 |
| L | 100% Phenyl acetate | 1 Hour |
| M | 100% Nonylphenyl benzoate | 1 |
| N | 50% Nonylphenyl benzoate<br>50% Dodecylbenzene | 1 |

The results in Table 2 again illustrate the superior performance obtained with those aryl esters within the scope of this invention, viz. Solvents I, M and N.

With reference to the dye solvent compositions described in Tables 1 and 2 above, the recitation of crystal violet lactone dye within the compositions was omitted from the percentage numbers solely for convenience of expression.

Although a preferred embodiment of this invention comprises a two-sheet system wherein the acidic receiving material is carried by one sheet and a marking fluid comprising a chromogen and solvent is carried by a second sheet, the marking fluid being released onto the acidic material by the application of pressure, the invention is not limited to such systems alone. The only essential requirement for a pressure-sensitive recording system is that the chromogen and the acidic sensitizing material be maintained in a separate or unreactive condition until pressure is applied to the system and that upon the application of pressure the chromogen and acidic material are brought into reactive contact. Thus it is possible to have the chromogen and acidic material present in a dry and unreactive state on a common carrier and to have the solvent alone carried on a separate sheet whereupon the application of pressure would release the solvent into the chromogen-acidic material mixture and promote localized reaction and color development. Obviously, many other arrangements, configurations and relationships of the solvent and the mark forming materials with respect to their encapsulation and location on the supporting sheet or webs can be envisioned, and such arrangements are within the scope of the present invention. For example, it is possible to coat a single paper or support member with all the components of this system to form a single self-contained unit which can be marked by the movement of a stylus or other pressure imparting means upon the surface of the paper. Such papers are particularly useful for use in inkless recording instruments.

Thus, the present invention encompasses pressure-sensitive recording paper systems utilizing a chromogenic material, an acidic sensitizing material, and a solvent comprising certain aryl esters of benzoic acid or $C_1$ to $C_2$ alkyl-substituted benzoic acid. Benzyl esters of benzoic acid are preferred with benzyl benzoate being a superior species. Benzyl benzoate has the structure: encompasses

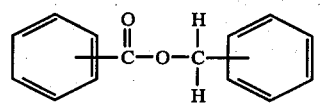

A known method for preparing benzyl benzoate is by reacting 2 moles of benzaldehyde in the presence of the sodium salt of benzyl alcohol.

The acid moiety for preparing the aryl esters of this invention can be benzoic, methylbenzoic (toluic), or ethylbenzoic acid.

The alcohol moiety for the esters of this invention can be alkyl-substituted as set forth in the $R_2$ and $R_3$ substituent definitions of the generic structural formula. The $R_2$ group, e.g. can be lower alkyl, t-butyl, heptyl, octyl or nonyl. The substituents $R_2$ and $R_3$, when methyl or ethyl, can be alike or different.

Many variations and combinations in the application of these reactants and dye solvents to prepare pressure-sensitive recording paper systems will be apparent to and within the knowledge of those skilled in the art and will depend upon such factors as the type of chromogenic material selected, the nature of the coating to be applied and its method of application. Also deemed important are the number of supporting substrates employed and the intended application of the system. Accordingly, the present invention is not to be limited by the specific details presented in the preceding descriptions and examples.

The embodiments of the invention in which an exclusive property or privilege is claimed are defined as follows:

1. A pressure-sensitive recording system comprising
(a) supporting sheet material,
(b) mark forming components arranged in contiguous juxtaposition and supported by said sheet material, said components comprising a chromogenic material held within microcapsules and an electron accepting material of the Lewis acid type reactive with said chromogenic material to produce a mark when brought into reactive contact, and
(c) a pressure releasable solvent for said chromogenic mark forming component, said solvent comprising an aryl ester represented by the structure

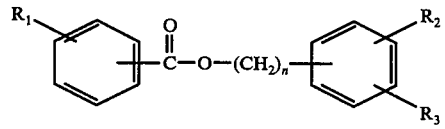

wherein $R_1$ is hydrogen, methyl or ethyl; $R_2$ is hydrogen or $C_1$ to $C_9$ alkyl; $R_3$ is hydrogen, methyl or ethyl; and $n$ is zero or 1.

2. A system of claim 1 wherein the electron accepting material of the Lewis acid type is selected from the group consisting of acidic clay and acidic organic polymers.

3. A system of claim 1 wherein the chromogenic material is dissolved in the solvent prior to bringing said chromogenic material and said electron accepting material into reactive contact.

4. A system of claim 1 wherein the mark forming components and the solvent are present on a single support paper sheet.

5. A system of claim 1 wherein the chromogenic material comprises a phthalide compound.

6. A system of claim 2 wherein the electron accepting material of the Lewis acid type is a phenolic polymer.

7. A system of claim 1 wherein $R_1$ is hydrogen; $R_2$ is methyl, ethyl or t-butyl; $R_3$ is hydrogen; and $n$ is a 1.

8. A system of claim 1 wherein the solvent is represented by the structure

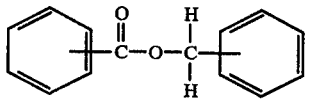

9. A pressure-sensitive recording system comprising (a) a first support sheet having disposed thereon a coating of a pressure releasable marking fluid held within microcapsules, and (b) A second supporting sheet having disposed thereon a coating of an electron accepting material of the Lewis acid type arranged in contiguous juxtaposition with the coating on said first supporting sheet, said marking fluid comprising a solvent and a colorless or substantially colorless chromogenic material dissolved therein, said chromogenic material being reactive with said Lewis acid type material to produce a colored mark and said solvent comprising an aryl ester represented by the structure

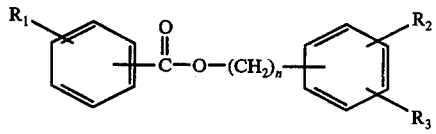

wherein $R_1$ is hydrogen, methyl or ethyl, $R_2$ is hydrogen or $C_1$ to $C_9$ alkyl; $R_3$ is hydrogen, methyl or ethyl; and $n$ is zero or 1.

10. A system of claim 9 wherein $R_1$ is hydrogen; $R_2$ is methyl, ethyl or t-butyl; $R_3$ is hydrogen, and $n$ is 1.

11. A system of claim 9 wherein the chromogenic material comprises a phthalide compound.

12. A system of claim 9 wherein the electron accepting material of the Lewis acid type is a phenolic polymer.

13. A system of claim 9 wherein the solvent is benzyl benzoate.

* * * * *